United States Patent [19]

Massey et al.

[11] 4,326,627

[45] Apr. 27, 1982

[54] LIMIT SWITCH FOR ROTARY CONTROL DEVICE

[75] Inventors: Roger G. Massey, Exeter; David G. Holloway, Concord, both of N.H.

[73] Assignee: Parker & Harper Mfg. Co., Worcester, Mass.

[21] Appl. No.: 98,625

[22] Filed: Nov. 29, 1979

[51] Int. Cl.[3] ..... H01H 3/16

[52] U.S. Cl. ..... 200/47; 200/153 LB

[58] Field of Search ..... 200/47, 153 LB, 153 L, 200/153 T, 330, 331

[56] References Cited

U.S. PATENT DOCUMENTS

| | | | |
|---|---|---|---|
| 3,275,764 | 9/1966 | Kiessling et al. | 200/47 |
| 3,303,299 | 2/1967 | Raymond, Jr. | 200/47 |
| 3,590,177 | 6/1971 | Ustin | 200/47 |
| 3,621,172 | 11/1971 | Clark | 200/47 |
| 3,670,128 | 6/1972 | Estrem | 200/153 LB |
| 3,688,593 | 9/1972 | Ustin | 200/47 |
| 3,739,113 | 6/1973 | Gruenwald | 200/47 |
| 3,980,852 | 9/1976 | Redfield | 200/153 LB |
| 4,171,472 | 10/1979 | Elliott | 200/47 |

FOREIGN PATENT DOCUMENTS

| | | | |
|---|---|---|---|
| 1004031 | 9/1965 | United Kingdom | 200/47 |

*Primary Examiner*—Willis Little

[57] ABSTRACT

An explosion-proof limit switch having an explosion proof housing that mounts to the side of a rotary control device with actuation pins extending through annular seals to be driven by a cam on the rotary shaft of the control device. Switching units mounted inside the explosion-proof housing are mounted on a fixed pivot at a first mounting point and held resiliently at a second mounting point in a double acting adjustable spring assembly which acts both to adjusting the switching point and to absorbing excessive impact or actuating throw so as to reduce possibility of damage.

3 Claims, 4 Drawing Figures

LIMIT SWITCH FOR ROTARY CONTROL DEVICE

BACKGROUND OF THE INVENTION

1. Field of the Invention

Present invention relates to limit switches and particularly to such switches mounted in explosion proof housings for providing limit indications of the positions of rotary driven control devices such as rotary valves.

2. Description of the Prior Art

Small sensitive switches are in common use today for electronic and electro mechanical equipment as interlocks and position sensors. In most usages, there are no particular requirements for reducing hazards of flame, explosion or corrosion. However, in a number of rotary control devices, such as for example rotary valves, operation in the presence of acids and or alkalines is fairly common as well as operation with explosive and inflammable gases and liquids. In these same situations, it is frequently a necessity or at least a high desirability to be able to know the position of the control device or to interlock the position of a control device with some other device or indicator.

Limit switches that are sealed for protection against one of the above conditions have been built into a rotary control device as an inherent part of the device. They have also been mounted on the end of a rotary control shaft of a control device. Generally the limit switches mounted on the end of a control shaft prevent manual override operation of the control shaft. Limit switches built into a control device require disassembly of the device for any maintenance of the switch. Installation and removal of explosion-proof limit switches are cumbersome with difficultly in adjustment.

SUMMARY OF THE INVENTION

In accordance with the present invention, a limit switch assembly for rotary control devices utilizes a lobed cam on a rotary control shaft of the control device, a limit switch mounting bracket secured to the control device enclosing the cam, a limit switch housing adapted to mount to the bracket, at least one sensitive switch pivotally mounted inside the switch housing and having an actuator facing in the direction of the lobed cam, a switch probe mounted through a sleeve in the housing for contacting said lobed cam at one end and said actuator at the other end, and an adjustable spring mounting pivotally positioning the switch for adjustment of the actuating point.

DESCRIPTION OF THE PREFERRED EMBODIMENT

Figure 1:
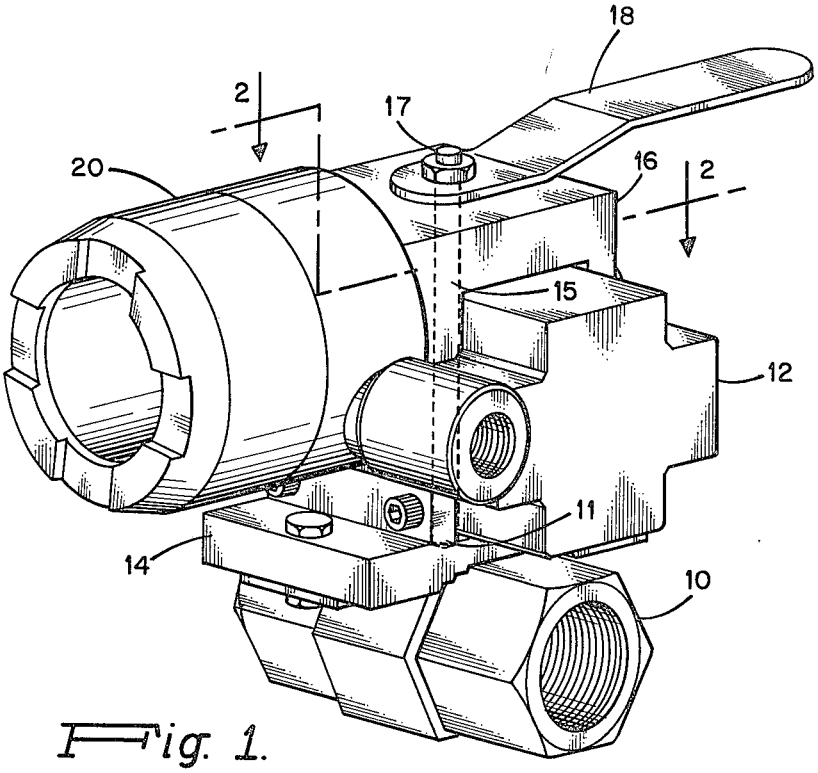
FIG. 1 is a perspective view of a rotary valve assembly assembled together with a power actuator and a limit switch assembly in accordance with the invention.

FIG. 1 depicts a powered control device and a limit switch in accordance with the invention. The control device is depicted as ball valve 10 and power actuator 12. Power actuator 12 as depicted is a pneumatic actuator but the type of actuator is not critical and whether or not there is a power actuator is not significant to the invention. Ball valve 10 is clamped to power actuator 12 by bracket assembly 14. Extension 15 of ball valve stem 11 extends through actuator 12 protruding a distance on the other side. This extension 15 is suitably part of power actuator 12 connected to stem 11 internally of actuator 12 on the other side of actuator 12 from valve 10. Mounting bracket 16 is secured to actuator 12 surrounding a portion of the protruding extension 15.

Figure 2:
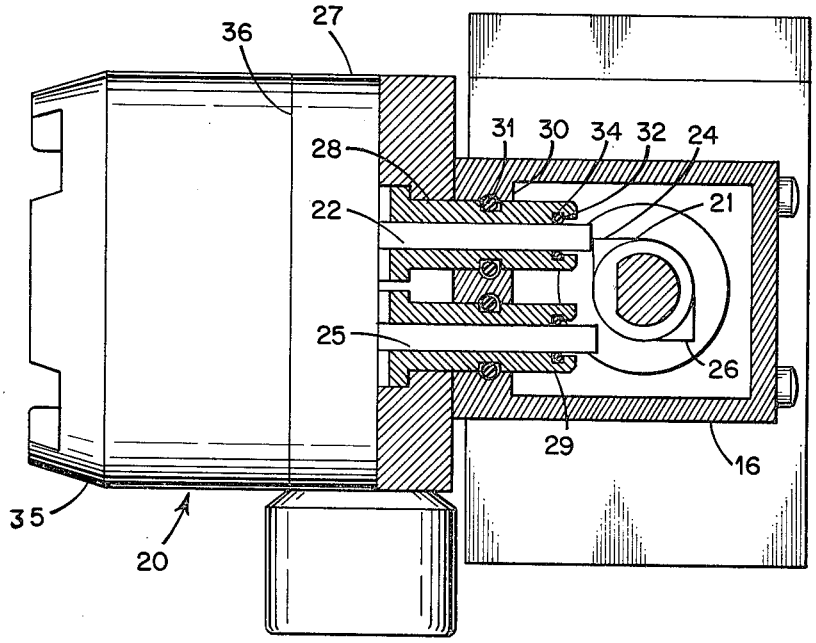
FIG. 2 is a partial section along 2—2 of FIG. 1.

Terminal end 17 of extension 15 extended through bracket 16 carries manual control handle 18. Mounted in a direction perpendicular to the axis of stem 11 to bracket 16 is explosion-proof limit switch 20. A section through bracket 16 and part of explosion proof limit switch 20 is depicted in FIG. 2 showing two-lobed cam 21 mounted on extension 15 inside bracket 16.

Switch 20 on first actuator pin 22 responsive to lobe 24 of cam 21 and second actuator pin 25 responsive to lobe 26 of cam 21. Thus probe 22 is actuated when stem 11 is in one position of rotation (that one that is depicted in FIG. 2) and pin 25 is actuated when stem 11 is rotated to a second position. Pin 22 is supported inside housing 27 by sleeve 28. Sleeve 28 passes through wall 30 of bracket 16 and is sealed against gas or liquid seepage by annular sealing ring 31 suitably made from synthetic rubber. A further annular seal 32 of similar material is carried in internal groove 34 of sleeve 28 to seal pin 22. Housing 27 has a cover portion 35 which screws on to housing 27 to seal at flange 36.

Figure 3:
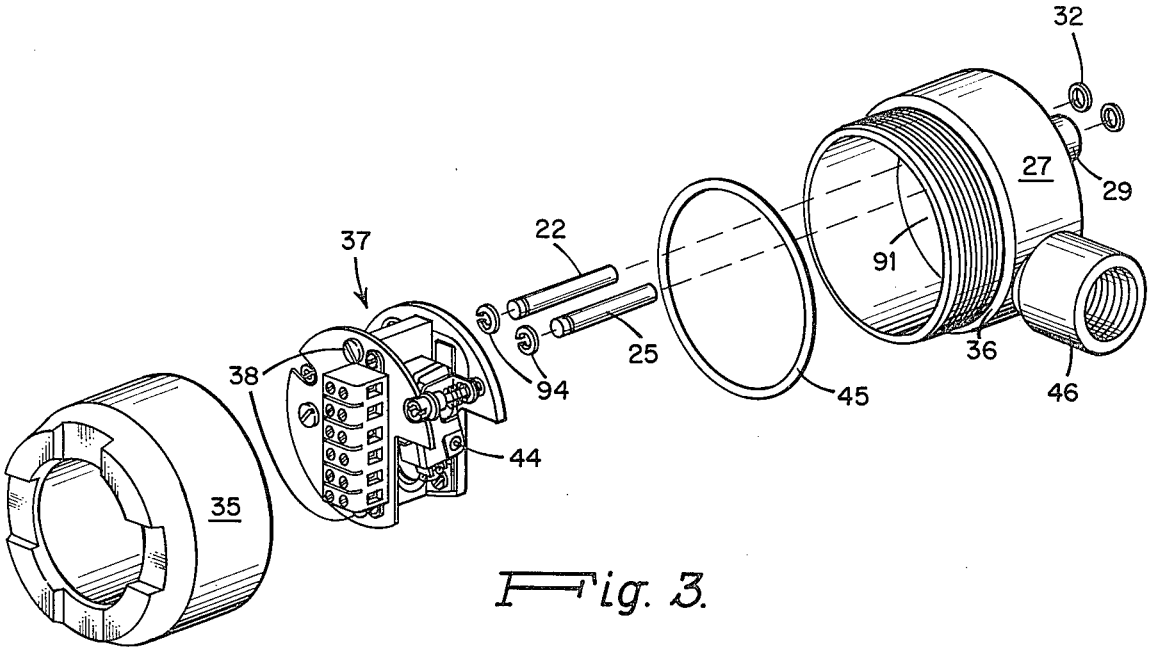
FIG. 3 is an exploded view of the housing enclosing the switch assembly.

Referring to FIG. 3, switch subassembly 37 is mounted inside housing 27 by machine screws 38 which pass through subassembly 37 and thread into tapped holes in the base of housing 27. Actuation pins 22 and 25 supported in sleeves 28 and 29 are positioned to contact switch actuators 40 and 41 of sensitive switches 42 and 44 respectively, see FIG. 4.

In FIG. 3 it will be seen that annular seal ring 45 is adapted for positioning against flange 36 of housing 27 so that when cover 35 is threaded over housing 27, an air tight seal is produced. Internal threaded extension 46 from housing 27 is of a conventional type for receiving an electrical cable with an air tight fit.

Figure 4:
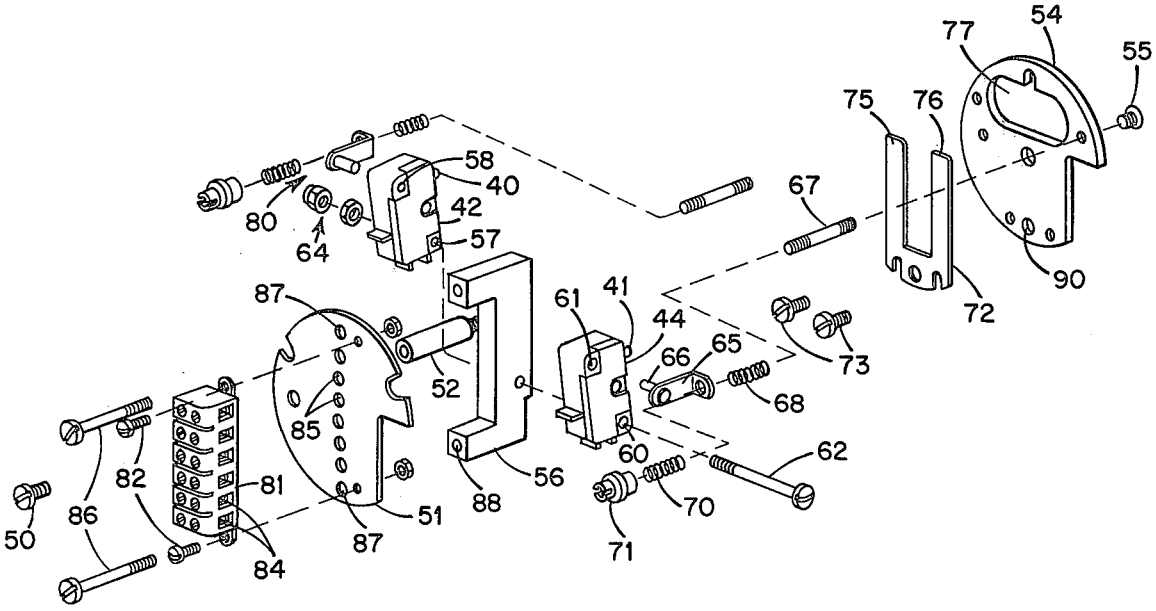
FIG. 4 is an exploded view of the switch assembly itself.

Switch subassembly 37 is shown in exploded view in FIG. 4. For ease of assembly in manufacture, subassembly 37 is assembled with screw 50 securing terminal support 51 to standoff 52. A male threaded end (not shown) of standoff 52 threads into support plate 54. In addition, screw 55 passes through the center of support plate 54 and threads into switch support 56.

In the subasembly depicted, two sensitive switches 42 and 44 are mounted on opposite sides of switch support 56. Switch 42 has two diagonally opposite mounting holes 57 and 58. Switch 44 has similar mounting holes 60 and 61. A machine screw 62 passes through mounting hole 60, switch support 56 and mounting hole 57 to secure switches 42 and 44 on opposite sides of switch support 56. Machine screw 62 is secured by locking nuts 65 to provide a fixed mounted that leaves switches 42 and 44 free to pivot.

Bracket 65 has a pin 66 that passes into mounting hole 61. Stud 67 is threaded at both ends with one end threaded into support plate 54. Compression spring 68 extends over stud 67 followed by bracket 65 and second compression spring 70. Finally an adjusting nut 71 is threaded over the second threaded end of stud 67. Two-armed leaf spring 72 is secured by screws 73 to support plate 54 with the two arms 75 and 76 facing aperture 77 in plate 54 to permit impingement of actuator pins 22 and 25. Arms 75 and 76 are also located so that when acted upon by pins 22 and 25 they contact switch actuators 40 and 41 respectively. The exact position of actuator 41 with respect to spring arm 76 is controlled by moving bracket 65 whereby switch 44 pivots on screw 62. This is performed in an adjustable manner by adjusting nut 71 acting with the spring assembly on stud 67. Similar spring loaded adjusting assembly 80 is provided for switch 42.

Terminal strip 81 mounts to terminal support 51 by screws 82. Both terminal strip 81 and terminal support 51 are made of an insulating material such as a phenolic or rigid plastic. Terminal strip 81 is depicted as accommodating six electric leads connectable at terminals 84. Extending lug terminals (not shown) passing through apertures 85 in support 51 provide for connecting to three terminals each on switches 42 and 44. Machines screws 86 extend through apertures 87 at the top and bottom of support 51, through corresponding apertures 88 in support 56, corresponding apertures 90 in plate 54 and finally into base 91 of housing 27 (see FIG. 3). Base 91 has threaded apertures (not shown) for receiving screws 86.

In assembly, subassembly 37 is held together essentially by standoff 52, screw 50 and screw 55. When fully assembled, subassembly 37 is then secured into housing 27 by screws 86. It will be seen that actuator pins 22 and 25 are passed through their respective sleeves 28 and 29 before subassembly 37 is installed in housing 27. Pins 22 and 25 each have split rings 94 snapped to their inside ends to prevent their passing out through sleeves 28 and 29.

In operation housing 27 is secured to mounting bracket 16 by set screws (not shown) acting against sleeves 28 and 29. Switches 42 and 44 are adjusted by their respective adjusting assemblies to provide electrical open and close at the desired position of valve 10. It will be remembered that valve 10 is only exemplary and other control devices may be used. After adjustment, cover 35 is threaded on to housing 27 to produce the desired explosion-proof closure.

While the invention has been described with relation to a specific embodiment, there are a number of variations that will be obvious to those skilled in the art. The number of sensitive switches mounted in the explosion-proof switch assembly is not critical and additional lobes can be provided on cam 25 or stacked cams may be used to operate the number of switch functions desired. It is to be noted that a feature of the present invention is the ability to remove the explosion proof switch by merely releasing the set screws bearing against sleeves 28 and 29. The control device remains undisturbed and operative. Nor is disassembly required other than removal of cover 35 in order to make switching adjustments.

Since many variations are contemplated within the skill of the art, it is intended to cover the invention as set forth in the scope of the appended claims.

We claim:

1. In combination, a rotary control device and a limit switch assembly for said rotary control device comprising:

a. A cam mountable on a rotary shaft of said control device for rotation therewith;

b. a mounting bracket securable to said rotary control device for enclosing said cam;

c. a limit switch housing comprising a body and a cover;

d. means to mount said body to said bracket;

e. at least one switch probe mounted to pass through said body and contact said cam;

f. at least one sensitive switch pivotally mounted in said body and having an actuator facing said probe; and, g. an adjustable spring loaded mounting pivotally positioning said switch for actuator adjustment, said sensitive switch having a first mounting point distant from said actuator, a second mounting point near said actuator, a fixed mounting support at said first mounting point about which said sensitive switch may pivot, and said spring loaded mounting support at said second mounting point held between two springs and adjustable by changing the tensions on said two springs whereby, when said cam bracket and body are mounted on said rotary control device, rotation of said cam with movement of said rotary control device moves said probe so as to operate said actuator opening and closing said switch at a point adjustable by said spring loaded mounting.

2. A limit switch assembly according to claim 1 wherein said cam has two lobes, said at least one sensitive switch is two switches and said at least one switch probe is two probes each probe positioned to be driven by a respective one of said two lobes.

3. A limit switch assembly according to claim 1 wherein said control device consists of a rotary valve for fluid control, said cam being mounted on a rotary shaft of said valve and said mounting bracket being secured to said valve.

* * * * *